US006357944B1

(12) United States Patent
Reed et al.

(10) Patent No.: US 6,357,944 B1
(45) Date of Patent: Mar. 19, 2002

(54) CRAYON PROTECTOR

(75) Inventors: Frank Reed; Christina Reed, both of 72 Broadacre Dr., Mt. Laurel, NJ (US) 08054

(73) Assignees: Frank Reed; Christina Reed, both of Mt. Laurel, NJ (US)

( * ) Notice: Subject to any disclaimer, the term of this patent is extended or adjusted under 35 U.S.C. 154(b) by 0 days.

(21) Appl. No.: 09/814,681

(22) Filed: Mar. 19, 2001

(51) Int. Cl.[7] ..... B43K 23/00
(52) U.S. Cl. ..... 401/88
(58) Field of Search ..... 401/88, 96, 6

(56) References Cited

U.S. PATENT DOCUMENTS 2,205,907 A 6/1940 Oxley
3,249,092 A 5/1966 Moojen
D311,421 S * 10/1990 Murdock ..... D19/55
5,522,960 A 6/1996 Rello et al.
5,957,604 A 9/1999 Anderson
6,063,222 A 5/2000 Deal

* cited by examiner

*Primary Examiner*—David J. Walczak
*Assistant Examiner*—Peter deVore
(74) *Attorney, Agent, or Firm*—Stuart M. Goldstein

(57) ABSTRACT

A crayon protector comprises a covering which is substantially cylindrical in configuration. The covering is made of unbreakable, non-cuttable, yet flexible material, for instance molded plastic. The covering is configured with open ends and a longitudinal slit which prevents complete encircling of the crayon. The covering is inserted on a crayon and substantially surrounds and reinforces it from breakage at its break zone. The slit facilitates insertion and removal and allows flexible expansion of the covering for use with crayons of varying diameters. The protector can also be used to prevent breakage of other relatively easily breakable writing implements, like chalk, pastel and charcoal sticks.

4 Claims, 2 Drawing Sheets

CRAYON PROTECTOR

BACKGROUND OF THE INVENTION

Every parent, at one time or another, has purchased a box of crayons for his or her children. Indeed, most parents have had to incur the expense of buying multiple boxes of crayons, following the breakage of crayons which children refuse to use in a broken state. While any given crayon is not expensive, the continual need to buy additional crayons in place of ones that have broken can become expensive and bothersome. In addition, the user of crayons of unique colors may wish to ensure that such crayons are maintained as long as possible, without breaking. Towards this end, protective coverings for crayons have been suggested.

Prior protective coverings for crayons contemplate the use of permanent wrappings or sheathings which are configured to be manufactured and used with an individual crayon. As the crayon material is used, the wrapping or sheathing is routinely peeled or cut away to allow exposure to additional crayon material. Once the crayon is completely spent, so is the wrapping and sheathing and the crayon is discarded. Examples of such prior crayon protection elements are found in U.S. Pat. Nos. 3,249,092, 5,522,960, 5,957,604, and 6,063,222. Other crayon protectors, as is shown in U.S. Pat. No. 2,205,907, are also designed to be used with one individual crayon and, following the use with the crayon, disposed of.

SUMMARY OF THE INVENTION

It is thus the object of the present invention to overcome the limitations and disadvantages of prior crayon protectors.

It is an object of the present invention to provide a crayon protector which is cylindrical in configuration and constructed of unbreakable, non-cuttable, yet flexible material.

It is a further object of the present invention to provide a crayon protector which substantially surrounds and reinforces a crayon at its break zone.

It is another object of the present invention to provide a crayon protector which is configured to be inserted onto a crayon, removed from the crayon after use, and reused on a different crayon.

It is still another object of the present invention to provide a crayon protector which has a longitudinal slit which allows it to be slidably inserted onto and removed from the crayon and also allows flexible expansion for the insertion of crayons of varying diameters.

It is still another object of the present invention to provide a crayon protector which is economical and efficiently manufactured for ready sale.

It is a further object of the present invention to provide a writing implement protector which can not only be used for crayons, but also for chalk, pastel and charcoal sticks, and similar breakable writing implements.

The present invention consists of a crayon protector comprising a covering which is substantially cylindrical in configuration. The covering is made of unbreakable, non-cuttable, yet flexible material, for instance molded plastic. The covering is configured with open ends and a longitudinal slit which prevents complete encircling of the crayon. The covering is inserted on a crayon and substantially surrounds and reinforces it from breakage at its break zone. The slit facilitates insertion and removal and allows flexible expansion of the covering for use with crayons of varying diameters. The protector can also be used to prevent breakage of other relatively easily breakable writing implements, like chalk, pastel, and charcoal sticks.

The novel features which are considered as characteristic of the invention are set forth in particular in the appended claims. The crayon protector itself, however, as to its design, construction, and use, together with additional features and advantages thereof, are best understood upon review of the following detailed description with reference to the accompanying drawings.

DETAILED DESCRIPTION OF THE INVENTION

Figure 1:
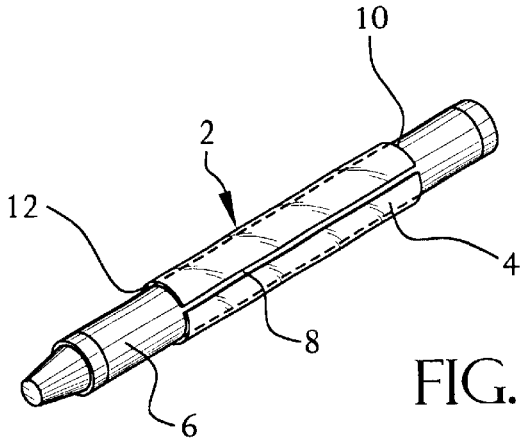
FIG. 1 is a perspective view of the crayon protector of the present invention.
Figure 2:
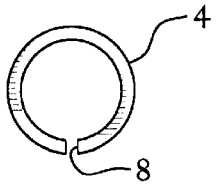
FIG. 2 is an end view of the crayon protector of the present invention.
Figure 3:
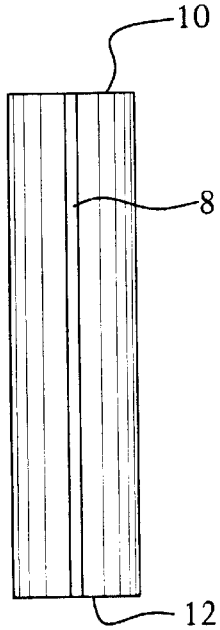
FIG. 3 is a side view of the crayon protector of the present invention.

Crayon protector 2 comprises a cylindrical covering 4 made preferably of molded plastic material. Covering 4 is configured to be unbreakable, non-cuttable, yet flexible enough to allow expansion when crayon 6 is inserted therein. The wall thickness of covering 4 is optimally contemplated to be between 0.030 and 0.060 inches. Covering 4 further comprises longitudinal slit 8 which facilitates sliding insertion onto and removal from crayon 6. Slit 8 also allows flexible expansion of covering 4 for the insertion of crayons of varying diameters.

Covering 4 comprises open ends 10 and 12. Crayon 6 can be inserted through either end of covering 4.

In use, a crayon, such as crayon 6, is inserted into crayon protector 2 at one of its ends 10 or 12. Covering 4 expands appropriately, depending on the diameter of crayon 6, to allow insertion of the crayon. Crayon protector 2 is positioned on crayon 6 in the crayon's break zone region, typically where the user grasps the crayon. The break zone is that area which is more likely to cause breakage to crayon 6 during use.

As the material in crayon 6 is used during the coloring process, crayon protector 2 is appropriately repositioned on the crayon to maintain it in the constantly changing break zone of the shortening crayon. Crayon protector 2 can be maintained on crayon 6 until substantially all crayon material has been used. At that time, crayon protector 2 can be easily removed from the remaining crayon material and reinserted onto another crayon for reuse.

Given the flexible, yet substantially unbreakable and uncuttable material which is used for crayon protector 2, it can be reused many times, on different crayons. The flexible nature of crayon protector 2 in tandem with its longitudinal slit 8, allows easy and ready use on crayons of varying diameters. Crayon protector 2 also assists in providing a friction grip to the user and especially helps younger children in holding a crayon.

Figure 4:
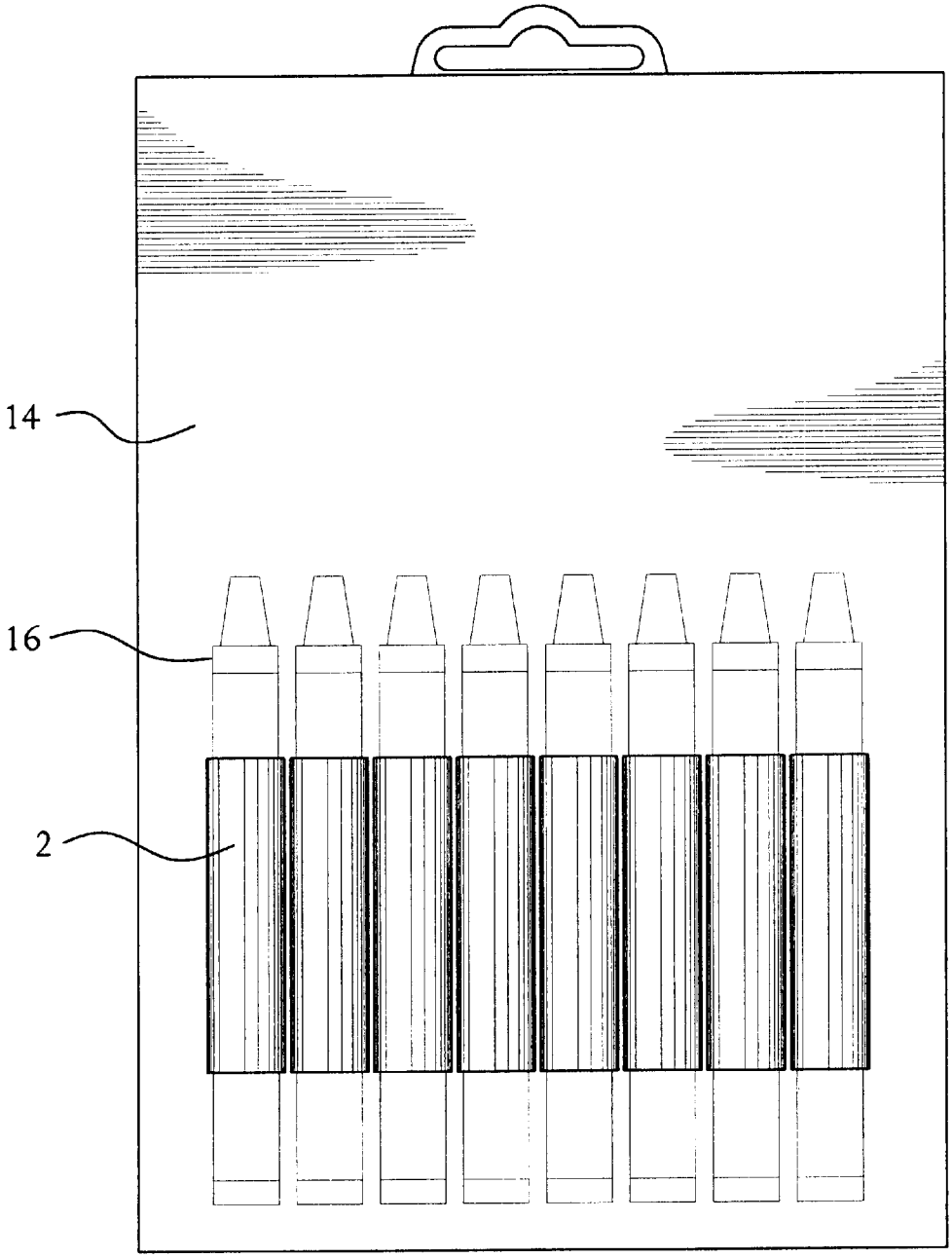
FIG. 4 is a view of several crayon protectors as they would be housed in packaging.

FIG. 4 shows an example of the manner in which crayon protector 2 can be presented in packaging 14, contemplated being made of cardboard or similar material, with outline 16 of crayons represented thereon.

Crayon protector 2, although shown in the preferred embodiment as having a rounded outer surface, can be produced with an outer shape in the form of a square, triangle, or other appropriate geometric configuration.

Although shown in the herein disclosure in use with crayons, crayon protector 2 enjoys similar success in preventing breakage of other writing implements, for instance, chalk, pastel and charcoal sticks.

While one embodiment of the invention has been described, the scope of protection to which the invention is believed entitled is defined by the claims and by equivalents thereto which perform substantially the same function in the substantially the same way to achieve substantially the same result as the subject matter defined literally by the claims, so long as such substantial equivalents, as defined by a claim for such substantial equivalence, do not read on the prior art.

We claim:

1. A writing implement protector for use on a writing implement which becomes shorter during use, the writing implement having a centrally located break zone region where a user grasps the implement, the break zone region constantly changing as the implement becomes shorter, said protector comprising a writing implement covering means substantially cylindrical in configuration, said covering means being of unbreakable, non-cuttable, flexible material and being configured to substantially surround and partially cover the writing implement solely around and over the break zone region of the implement, whereby when the covering means is in place over the break zone region, the covering means provides reinforcement of the implement solely at the break zone region, detering it from breaking, said covering means further being configured to be moved on and repositioned along the implement to maintain it solely around and over the break zone region, to continually reinforce the implement solely at the break zone region as the implement becomes shorter and the break zone region changes, and for removal from and reuse on a different writing implement, the covering means comprising a longitudinal slit to facilitate sliding insertion onto and removal from a writing implement and to allow flexible expansion of the flexible material of the covering means for the insertion of writing implements of varying diameters.

2. The writing implement protector of claim 1 in which the covering means is formed from molded plastic.

3. The writing implement protector of claim 1 in which the covering means is open at either end for ready insertion and removal from a writing implement.

4. The writing implement protector of claim 1 in which the writing implement is a crayon.

* * * * *